US011575187B2

(12) United States Patent
Ai et al.

(10) Patent No.: US 11,575,187 B2
(45) Date of Patent: Feb. 7, 2023

(54) ACTUATOR DEVICE FOR DRIVING A PHASE SHIFTER INCLUDING A LEAD SCREW THAT CAN BE AUTOMATICALLY LOCKED

(71) Applicant: CommScope Technologies LLC, Hickory, NC (US)

(72) Inventors: Bin Ai, Jiangsu (CN); Qiang Wang, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/342,638

(22) Filed: Jun. 9, 2021

(65) Prior Publication Data

US 2021/0399394 A1 Dec. 23, 2021

(30) Foreign Application Priority Data

Jun. 19, 2020 (CN) ..... 202010563964.2

(51) Int. Cl.
*H01P 1/18* (2006.01)
*H01Q 1/24* (2006.01)

(52) U.S. Cl.
CPC ..... *H01P 1/18* (2013.01); *H01Q 1/246* (2013.01)

(58) Field of Classification Search
CPC ..... H01P 1/18; H01P 1/184
USPC ..... 333/161, 156
See application file for complete search history.

(56) References Cited

U.S. PATENT DOCUMENTS

2017/0365923 A1* 12/2017 Schmutzler ..... H01P 1/184
2019/0331220 A1* 10/2019 Fu ..... F16H 63/30

* cited by examiner

*Primary Examiner* — Benny T Lee
(74) *Attorney, Agent, or Firm* — Myers Bigel, P.A.

(57) ABSTRACT

The present invention relates to a transmission device for a phase shifter and an actuator device for a phase shifter. The transmission device includes a support, a lead screw nut mechanism and an automatic locking device. The automatic locking device includes a shaft connector rotatably supported on the support and configured to be in transmission connection with a driven connector of a driving device; a locking connector which is in transmission connection with the shaft connector, is in transmission connection with the lead screw, has a locking element and is movable relative to the shaft connector and the lead screw; and a locking spring. When the driven connector is decoupled to the shaft connector, the locking spring biases the locking connector in a first position, in which the locking element engages a counter-locking element on the support. When the driven connector is decoupled to the shaft connector, the locking connector is moved by the driven connector to a second position, in which the locking element disengages the counter-locking element on the support. Calibration of the phase shifter may be saved when the driving device is replaced or repaired.

11 Claims, 4 Drawing Sheets

ACTUATOR DEVICE FOR DRIVING A PHASE SHIFTER INCLUDING A LEAD SCREW THAT CAN BE AUTOMATICALLY LOCKED

RELATED APPLICATION

The present invention claims priority from and the benefit of Chinese Patent Application No. 202010563964.2, filed Jun. 19, 2020, the disclosure of which is hereby incorporated herein by reference in full.

FIELD OF THE INVENTION

The present disclosure relates to the field of base station antennas, in particular to a transmission device for a phase shifter and an actuator device for a phase shifter.

BACKGROUND OF THE INVENTION

Base station antennas for wireless communication systems may be used to transmit and/or receive radio frequency (RF) signals. Base station antennas may be directional devices that can concentrate RF energy in specific directions. A radiation pattern of a base station antenna is a compilation of the gain of the base station antenna in all different directions. Now, many base station antennas have been deployed so that they have radiation patterns that can be reconfigured remotely. For example, a base station antenna may have an actuator device for actuating a phase shifter to change the electrical tilt of the base station antenna. Typically, an actuator device may be a multi-RET (remote electrical tilt) actuator device configured for remotely actuating a plurality of phase shifters.

Typically, an actuator device may include a driving device and a transmission device, the driving device may be controlled by control signals, and the transmission device may include a lead screw drive, a nut of which may be connected to a wiper of a phase shifter through a linkage rod. When the driving device is disassembled while being serviced, the lead screw drive may become loose, so when the disassembled driving device is reassembled or a new driving device is assembled, the position of the nut on the lead screw may change, and accordingly, a phase angle of the phase shifter associated with the lead screw drive and thus the electrical tilt of radiators may be uncertain. Therefore, the phase angle of the phase shifter may need to be recalibrated when the driving device is disassembled and reassembled.

SUMMARY OF THE INVENTION

It is an object of the disclosure to provide a transmission device for a phase shifter and an actuator device for a phase shifter including the transmission device, wherein recalibration of the phase angle of the phase shifter may be avoided when the driving device is disassembled and reassembled.

According to an aspect of the invention, a transmission device for a phase shifter is proposed, which includes a support and a lead screw drive, wherein the lead screw drive has a lead screw and a nut, the lead screw is rotatably supported on the support, and the nut is configured to drive the phase shifter, characterized in that the transmission device includes an automatic locking device for automatically locking the lead screw, and the automatic locking device includes:

a shaft connector rotatably supported on the support and configured to be in transmission connection with a driven connector of a driving device;

a locking connector that is in transmission connection with the shaft connector and the lead screw, has a locking element, and is movable relative to the shaft connector and the lead screw; and a locking spring;

wherein the locking spring biases the locking connector in a first position, in which the locking element engages a counter-locking element on the support, so that the locking connector is locked and thus the shaft connector and the lead screw are locked, when the driven connector is decoupled to the shaft connector:

wherein the locking connector is moved by the driven connector against a biasing force of the locking spring to a second position, in which the locking element disengages the counter-locking element on the support, so that the locking connector is unlocked and thus the shaft connector and the lead screw are unlocked, when the driven connector is coupled to the shaft connector.

By such a transmission device, the servicing of the base station antenna may be simplified. After removal of the driving device, only the driving device needs to be reassembled, and the complicated recalibration may be not necessary.

In some embodiments, the shaft connector may be configured to coaxially receive the driven connector.

In some embodiments, the shaft connector may have a first internal toothed portion configured to engage an external toothed portion of the driven connector.

In some embodiments, the shaft connector may have a first external toothed portion configured to engage an internal toothed portion of the driven connector.

In some embodiments, the shaft connector may be disposed axially parallel to the driven connector, wherein the shaft connector and the driven connector may each have an external toothed portion.

In some embodiments, the shaft connector may be configured to coaxially receive the locking connector.

In some embodiments, the shaft connector may have a second internal toothed portion that engages an external toothed portion of the locking connector.

In some embodiments, the shaft connector may have a second external toothed portion that engages an internal toothed portion of the locking connector.

In some embodiments, the shaft connector may be disposed axially parallel to the locking connector, wherein the shaft connector and the locking connector may each have an external toothed portion.

In some embodiments, the second internal toothed portion and the first internal toothed portion may be separated from each other or continuous with each other.

In some embodiments, the shaft connector may have a collar, the support may have a bearing, and the shaft connector is rotatably supported with the collar in the bearing.

In some embodiments, the bearing may be constructed in two parts, wherein a body of the support forms a part of the bearing and a bearing cover forms the other part of the bearing.

In some embodiments, the locking connector may have a receiving hole extending axially, the lead screw may have an end section, wherein the locking connector may be placed with the receiving hole onto the end section of the lead screw, and the receiving hole and the end section may have complementary non-circular cross sections, so that the locking connector is coaxially, non-rotatably and axially movably connected with the lead screw.

In some embodiments, the end section of the lead screw may have a spring receiving hole that extends axially and receives the locking spring.

In some embodiments, the locking connector may have a flange that may have a face toothed portion as the locking element, and the support may have a single tooth as the counter-locking element, wherein in the first position of the locking connector, the single tooth can engage into a tooth gap between two respective teeth of the face toothed portion.

In some embodiments, the lead screw may have a flange that may be associated with the flange of the locking connector for defining the second position of the locking connector.

In some embodiments, the locking element and the counter-locking element may be friction elements, wherein the locking connector is locked when the two friction elements are pressed by the locking spring, and the locking connector is unlocked when the two friction elements are separated.

In some embodiments, the transmission device may include a plurality of lead screw drives and a common support, and each lead screw drive may be provided with an automatic locking device. For example, the plurality of lead screw drives may be arranged side by side in parallel, or may be arranged in a circumferential distribution, or may be arranged in two rows overlapping each other.

According to a second aspect of the invention, an actuator device for a phase shifter is proposed, which includes a replaceable driving device having a driven connector. The actuator device further includes a transmission device for a phase shifter according to the first aspect of the invention, wherein the driven connector is in transmission connection with the shaft connector of the transmission device. When the driven connector is decoupled to the shaft connector, the locking spring of the transmission device biases the locking connector of the transmission device in the first position, in which the locking element of the locking connector engages the counter-locking element on the support of the transmission device, so that the locking connector is locked and thus the shaft connector and the lead screw of the transmission device are locked. When the driven connector is coupled to the shaft connector, the locking connector is moved by the driven connector against the biasing force of the locking spring to the second position, in which the locking element disengages the counter-locking element on the support, so that the locking connector is unlocked and thus the shaft connector and the lead screw are unlocked.

In some embodiments, the driving device is configured as a multi driving device that includes a plurality of driven connectors, and each driven connector is configured to drive one of the lead screw drives of the transmission device.

In some embodiments, the driving device may have two side rails configured to guide the driving device when the driving device is assembled to and disassembled from the base station antenna.

BRIEF DESCRIPTION OF THE DRAWINGS

The present invention will now be described in more detail by way of embodiments with reference to the accompanying drawings. Among them.

DETAILED DESCRIPTION OF THE EMBODIMENT

Figure 1:
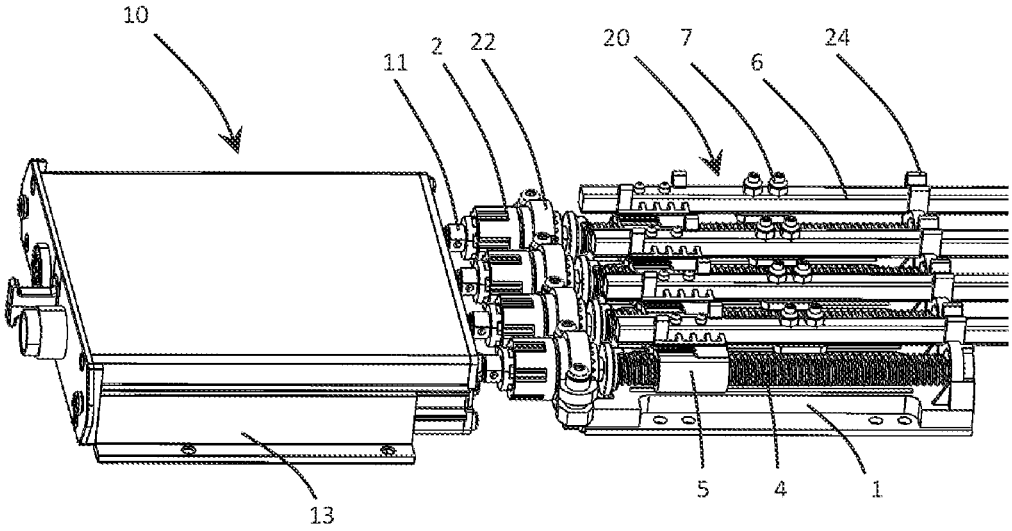
FIG. 1 is a partial perspective view of an actuator device for a phase shifter according to an embodiment of the present invention.
Figure 2:
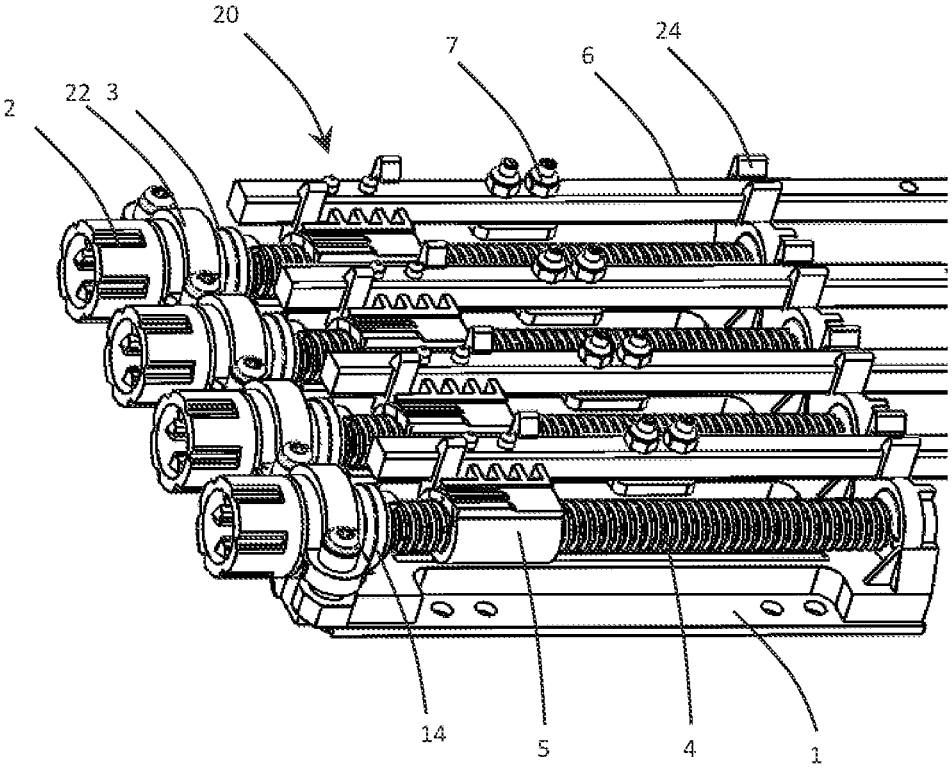
FIG. 2 is a partial perspective view of a transmission device of the actuator device of FIG. 1.
Figure 3:
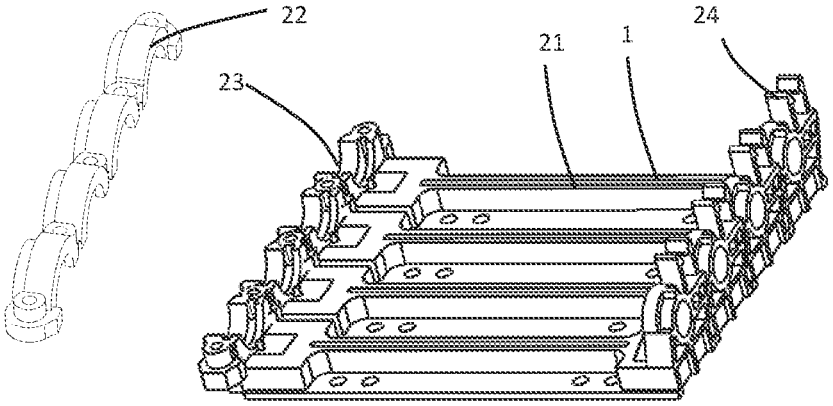
FIG. 3 is a perspective exploded view of a support of the transmission device of FIG. 2.
Figure 4A:
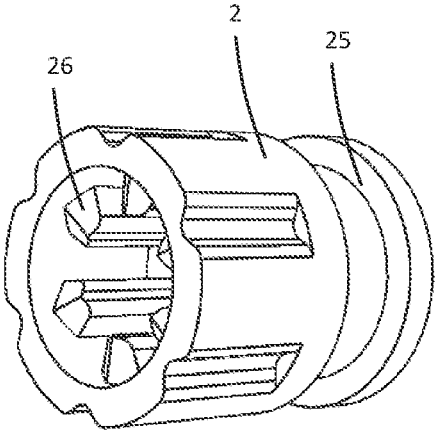
FIGS. 4A and 4B are two different perspective views of a shaft connector of the transmission device of FIG. 2.
Figure 4B:
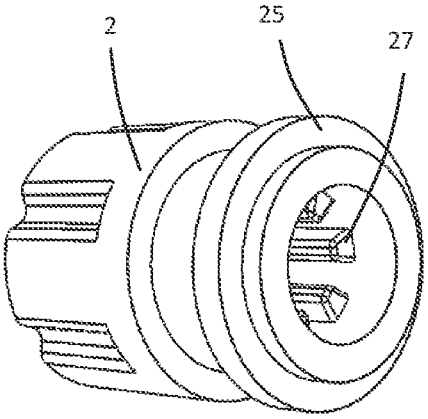
Figure 5A:
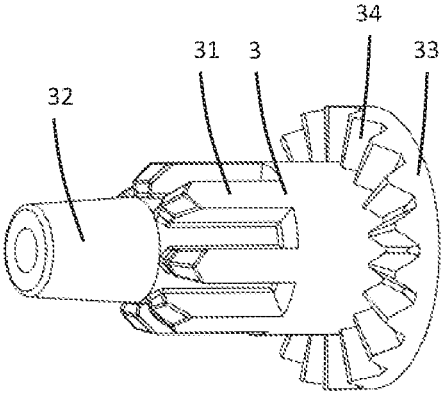
FIGS. 5A and 5B are two different perspective views of a locking connector of the transmission device of FIG. 2.
Figure 5B:
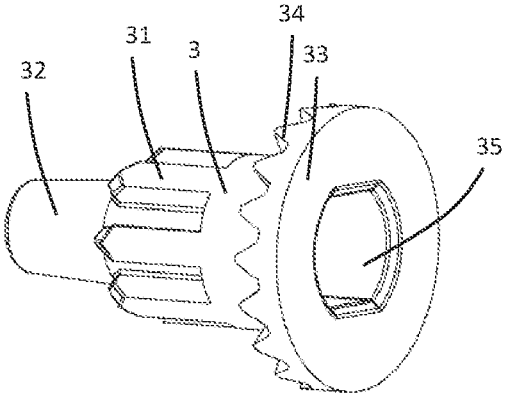

FIG. 1 is a partial perspective view of an actuator device for a phase shifter according to an embodiment of the present invention, and FIG. 2 is a partial perspective view of a transmission device of the actuator device of FIG. 1. The actuator device includes a replaceable driving device 10 and a transmission device 20. The driving device is configured as a multi-driving device including a plurality of driven connectors 11. The transmission device 20 includes a plurality of lead screw drives arranged side by side in parallel and a common support 1. Each driven connector 11 is configured to drive one of the lead screw drives of the transmission device 20. Each lead screw drive may be configured to drive a wiper of a phase shifter (not shown in the drawings), so that the phase shifter may be adjusted to a desired phase angle. The lead screw drive includes a lead screw 4 rotatably supported on the support 1 and a nut 5 configured to drive the phase shifter via a linkage rod 6, wherein the linkage rod 6 is illustrated with a partial length. In the shown embodiment, the number of driven connectors 11 and lead screw drives is four, respectively. It will be appreciated that the number of the driven connectors 11 and the lead screw drives may vary, for example, the number may be 1, 2, 3 or more. Typically, the driving device 10 may be an electric drive unit. It will also be appreciated that the driving device 10 may be a manual driving unit.

The driving device 10 may have two side rails 13 configured to guide the driving device 10 when the driving device 10 is assembled to and disassembled from a base station antenna (not shown in the drawings), so that the disassembly and assembly of the driving device may be easily achieved. Typically, in the prior art, the driving device 10 and the lead screw drives are disposed on a common base plate made of aluminum, which is mounted on a reflector plate of the base station antenna. In the embodiment shown in FIG. 1, such a base plate is omitted, which is cost-effective, and an additional space, which is originally occupied by the base plate, can be obtained for arranging transmission lines of the base station antenna.

Referring now to FIGS. 1-9, the transmission device 20 may include a shaft connector 2, which may be configured to be in transmission connection with the driven connector 11 of the driving device 10. To this end, the driven connector 11 may have an external toothed portion 12 (see FIG. 6), and the shaft connector 2 may have a first internal toothed portion 26 (see FIG. 4A) configured to engage the external toothed portion 12 of the driven connector. When the driving device 10 is in the assembled state, the driven connector 11 is inserted into the shaft connector 2, the external toothed portion 12 engages the first internal toothed portion 26, and the power can be transmitted from the driving device 10 to the shaft connector 2. When the driving device 10 is disassembled, the driven connector 11 is decoupled to the shaft connector 2, the external toothed portion 12 disengages the first internal toothed portion 26, and the power transmission from the driving device 10 to the shaft connector 2 is interrupted. The shaft connector 2 is rotatably supported on the support 1. To this end, the shaft connector 2 may have a collar 25, the support 1 may have a bearing 23, and the shaft connector 2 is rotatably supported with the collar 25 in the bearing 23. For easy installation, the bearing 23 may be constructed in two parts, wherein a body 21 of the support 1 forms a part of the bearing 23 and a bearing cover 22 forms the other part of the bearing 23. The bearing cover 22 may be fixed to the body 21 of the support 1 by screws.

Referring again to FIGS. 1-9, the transmission device 20 may include a locking connector 3 which is in transmission connection with the shaft connector 2 and the lead screw 4 of the lead screw drive. For the transmission connection of the locking connector 3 with the shaft connector 2, the shaft connector 2 may have a second internal toothed portion 27 (see FIG. 4B) and the locking connector 3 may have an external toothed portion 31 (see FIGS. 5A and 5B). The second inner toothed portion 27 engages the external toothed portion 31. The second internal toothed portion 27 and the first internal toothed portion 26 may be separated from each other or may be continuous with each other. The continuous configuration of the first inner toothed portion 26 and the second inner toothed portion 27 in an axial direction may lead to a simple structure of the shaft connector 2. For the transmission connection of the locking connector 3 and the lead screw 4, the locking connector 3 may have an axially-extending receiving hole 35 (see FIG. 5B), the lead screw 4 may have an end section 8 (see FIG. 6), and the locking connector 3 may be placed with the receiving hole 35 onto the end section 8 of the lead screw 4, wherein the receiving hole 35 and the end section 8 may have complementary non-circular cross sections, so that the locking connector 3 and the lead screw 4 are coaxially non-rotatably connected with each other. The locking connector 3 is axially movable between a first position and a second position. The locking connector 3 may have a locking element 34. Correspondingly, the support 1 may have a counter-locking element 28. In the shown embodiment, the locking connector 3 may have a flange 33 that may have a face toothed portion as the locking element 34, and the support 1 may have a single tooth as the counter-locking element 28. The single tooth can engage a tooth gap between respective two teeth of the face toothed portion. In the first position, the locking element 34 engages the counter-locking element 28, so that the locking connector 3 is locked, and thus the shaft connector 2 and the lead screw 4, which are in transmission connection with the locking connector 3, are also locked. In the second position, the locking element 34 disengages the counter-locking element 28, so that the locking connector 3 is unlocked, and thus the shaft connector 2 and the lead screw 4, which are in transmission connection with the locking connector 3, are also unlocked. The locking connector 3 may have an end section 32 with a reduced diameter which may be pushed by the driven connector 11. The lead screw 4 may have a flange 14. When the locking connector 3 is located in the second position, the flange 33 of the locking connector 3 can rest on the flange 14 of the lead screw 4 or have a slight clearance with the flange 14. The second position of the locking connector 3 can be clearly defined by means of the flange 14 of the lead screw.

Referring still to FIGS. 1-9, the transmission device 20 may include a locking spring 9 that biases the locking connector 3 in the first position. To this end, the end section 8 of the lead screw 4 may have a spring receiving hole that extends axially and receives the locking spring 9. The locking spring 9 may be a helical pressure spring, a sheet metal spring or any other type of suitable spring. When the driven connector 11 of the driving device 10 is inserted into the shaft connector 2, the driven connector 11 presses the locking connector 3 to the second position against a biasing force of the locking spring 9, so that the power can be transmitted from the driven connector 11 of the driving device 10 to the lead screw 4 via the shaft connector 2 and the unlocked locking connector 3, so that the phase shifter can be actuated by the nut 5 via the linkage rod 6. The movement range of the nut 5 may be defined by at least one stop arrangement. In the shown embodiment, one of the stop arrangements may be formed by a stop 7 mounted in the linkage rod 6 and a guide portion 24 for the linkage rod 6 protruding from the body 21 of the support 1, and the other stop arrangement may be formed by the nut 5 and the support 1. When the driving device 10 is disassembled, the driven connector 11 of the driving device 10 is pulled out from the shaft connector 2, and the locking spring 9 biases the locking connector 3 to the first position, so that the locking element 34 engages the counter-locking element 28, wherein the locking connector 3 is locked, and thus the shaft connector 2 and the lead screw 4 are also locked, and the position of the nut 5 on the lead screw 4 can be kept unchanged. Here, the locking device can be locked automatically with the disassembly of the driving device and unlocked automatically with the assembly of the driving device. Such a locking device may be referred to as an automatic locking device, whereby calibration after disassembly and reassembly of the driving device may be omitted.

Figure 6:
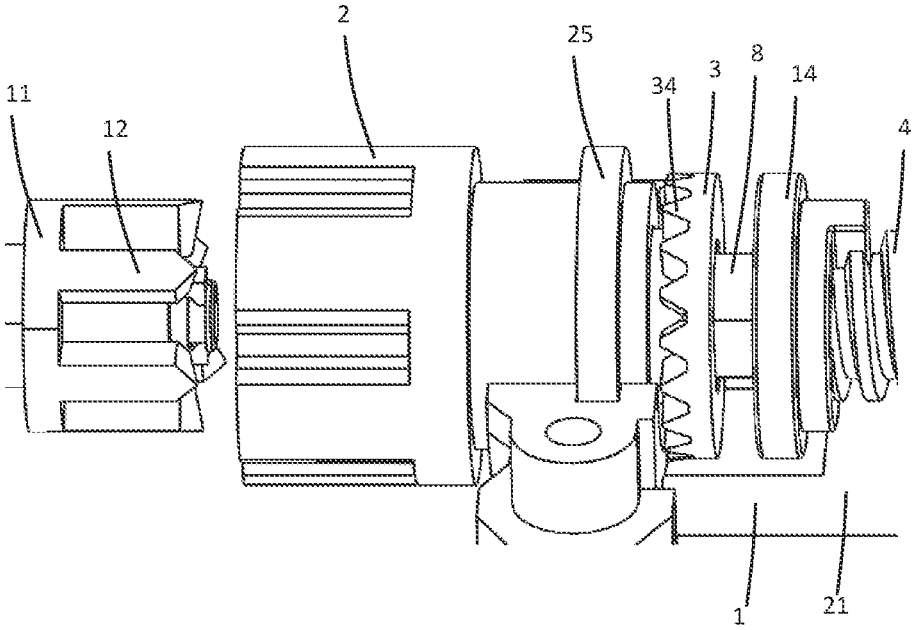
FIG. 6 is an enlarged perspective view of a cutaway section of the transmission device of FIG. 2 in a first state.
Figure 7:
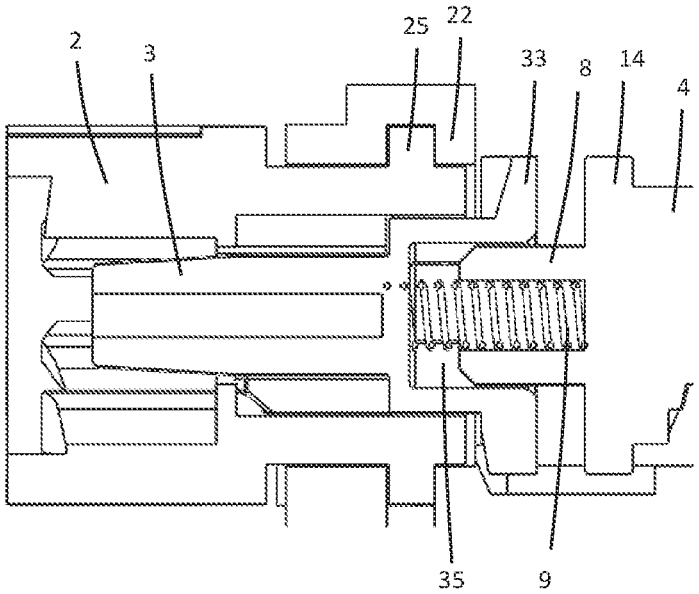
FIG. 7 is a longitudinal sectional view of the cutaway section of FIG. 6.

FIG. 6 is an enlarged perspective view of a cutaway section of the transmission device 20 of FIG. 2 in a first state, wherein an automatic locking device in association with one of the lead screw drives is illustrated, and one of the driven connectors 11 of the driving device 10 (FIG. 1) is additionally illustrated, which has not been inserted into the shaft connector 2. The locking connector 3 is located in the first position, and the locking element 34 engages the invisible counter-locking element 28. In FIG. 6, the bearing cover 22 (FIG. 1) is omitted in order to show the internal structure more clearly. FIG. 7 is a longitudinal sectional view of the cutaway section of FIG. 6, while the driven connector 11 is not shown.

Figure 8:
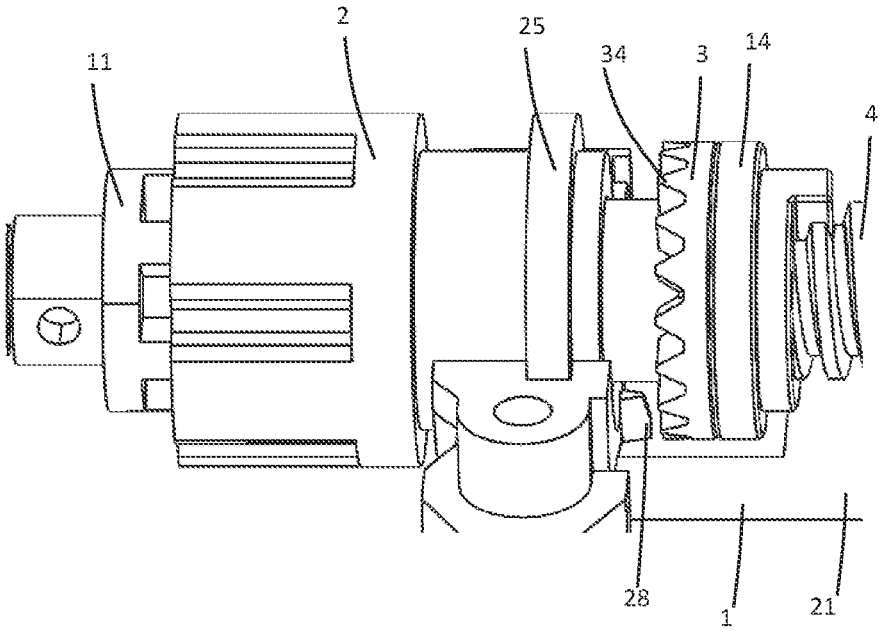
FIG. 8 is an enlarged perspective view of a cutaway section of the transmission device of FIG. 2 in a second state.
Figure 9:
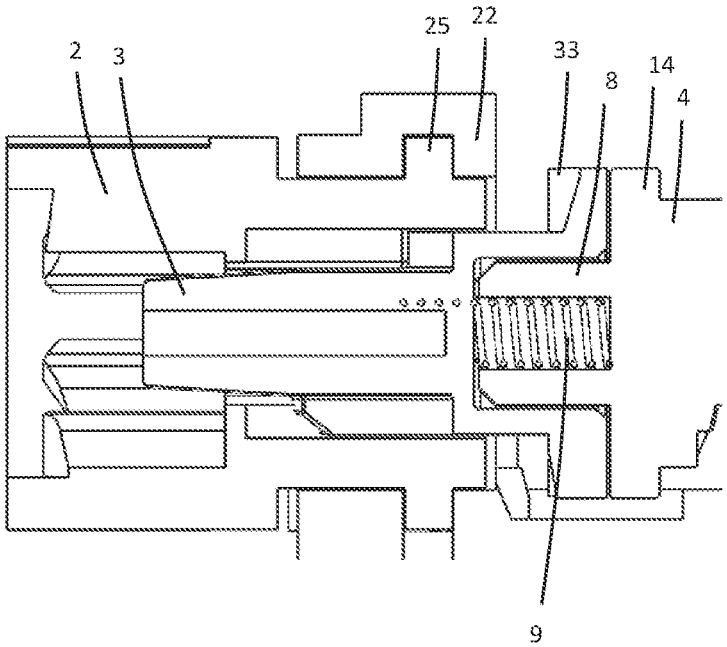
FIG. 9 is a longitudinal sectional view of the cutaway section of FIG. 8.

FIG. 8 is an enlarged perspective view of a cutaway section of the transmission device 20 of FIG. 2 in a second state, in which the automatic locking device in association with one of the lead screw drives is illustrated, and one of the driven connectors 11 of the driving device 10 is illustrated additionally, which has been inserted into the shaft connector 2. The locking connector 3 is located in the second position, and the locking element 34 disengages the counter-locking element 28 which is now visible. In FIG. 8, the bearing cover 22 (FIG. 1) is omitted in order to show the internal structure more clearly. FIG. 9 is a longitudinal sectional view of the cutaway section of FIG. 8, while the driven connector 11 is not shown.

In an alternative embodiment (not shown), the locking connector 3 may have a single tooth and the support 1 may have a toothed disc. In an alternative embodiment (not shown), the locking element and the counter-locking element may each be configured as a friction element. In an alternative embodiment (not shown), the locking element and the counter-locking element may each be constituted as a magnet. In still other embodiments (not shown), the teeth of the toothed sections may take different shapes (e.g., square, sawtooth, etc.).

It will be understood that, the terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprise" and "include" (and variants thereof), when used in this specification, specify the presence of stated operations, elements, and/or components, but do not preclude the presence or addition of one or more other operations, elements, components, and/or groups thereof. As used herein, the term "and/or" includes any and all combinations of one or more of the associated listed items. Like reference numbers signify like elements throughout the description of the figures.

The thicknesses of elements in the drawings may be exaggerated for the sake of clarity. Further, it will be understood that when an element is referred to as being "on," "coupled to" or "connected to" another element, the element may be formed directly on, coupled to or connected to the other element, or there may be one or more intervening elements therebetween. In contrast, terms such as "directly on," "directly coupled to" and "directly connected to," when used herein, indicate that no intervening elements are present. Other words used to describe the relationship between elements should be interpreted in a like fashion (i.e., "between" versus "directly between". "attached" versus "directly attached," "adjacent" versus "directly adjacent", etc.).

Terms such as "top," "bottom." "upper," "lower," "above," "below," and the like are used herein to describe the relationship of one element, layer or region to another element, layer or region as illustrated in the figures. It will be understood that these terms are intended to encompass different orientations of the device in addition to the orientation depicted in the figures.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

It will also be appreciated that all example embodiments disclosed herein can be combined in any way.

Finally, it is to be noted that, the above-described embodiments are merely for understanding the present invention but not constitute a limit on the protection scope of the present invention. For those skilled in the art, modifications may be made on the basis of the above-described embodiments, and these modifications do not depart from the protection scope of the present invention.

What is claimed is:

1. A transmission device for a phase shifter, including a support and a lead screw drive, the lead screw drive having a lead screw and a nut, the lead screw being rotatably supported on the support, the nut being configured to drive the phase shifter, characterized in that the transmission device includes an automatic locking device for automatically locking the lead screw, the automatic locking device including:

a shaft connector rotatably supported on the support, wherein the shaft connector is configured to be in transmission connection with a driven connector of a driving device;

a locking connector which is in transmission connection with the shaft connector and with the lead screw, wherein the locking connector has a locking element, and the locking connector is movable relative to the shaft connector and the lead screw; and a locking spring;

wherein the locking spring biases the locking connector in a first position, in which the locking element engages a counter-locking element on the support, so that the locking connector is locked and thus the shaft connector and the lead screw are locked, when the driven connector is decoupled to the shaft connector;

wherein the locking connector is moved by the driven connector against a biasing force of the locking spring to a second position, in which the locking element disengages the counter-locking element on the support, so that the locking connector is unlocked and thus the shaft connector and the lead screw are unlocked, when the driven connector is coupled to the shaft connector.

2. The transmission for a phase shifter as recited in claim 1, characterized in that the shaft connector is configured to coaxially receive the driven connector, wherein the shaft connector has a first internal toothed portion configured to engage an external toothed portion of the driven connector.

3. The transmission device for a phase shifter as recited in claim 2, characterized in that the shaft connector is configured to coaxially receive the locking connector, wherein the shaft connector has a second internal toothed portion that engages an external toothed portion of the locking connector, and the second internal toothed portion and the first internal toothed portion are separated from each other or are continuous with each other.

4. The transmission device for a phase shifter as recited in claim 1, characterized in that the shaft connector is configured to coaxially receive the locking connector, wherein the shaft connector has a second internal toothed portion that engages an external toothed portion of the locking connector.

5. The transmission device for a phase shifter as recited in claim 1, characterized in that the shaft connector has a collar, the support has a bearing, and the shaft connector is rotatably supported with the collar in the bearing.

6. The transmission device for a phase shifter as recited in claim 5, characterized in that the bearing is configured in two parts, wherein a body of the support forms a part of the bearing, and a bearing cover forms the other part of the bearing.

7. The transmission device for a phase shifter as recited in claim 1, characterized in that the locking connector has a receiving hole extending axially, the lead screw has an end section, the locking connector is placed with the receiving hole onto the end section of the lead screw, and the receiving hole and the end section have complementary non-circular cross sections, so that the locking connector is coaxially, non-rotatably and axially movably connected within the lead screw.

8. The transmission device for a phase shifter as recited in claim 7, characterized in that the end section of the lead screw has a spring receiving hole that extends axially and receives the locking spring.

9. The transmission device for a phase shifter as recited in claim 1, characterized in that the locking connector has a flange that has a face toothed portion as the locking element, the support has a single tooth as the counter-locking element, wherein in the first position of the locking connector the single tooth can engage a tooth gap between two respective teeth of the face toothed portion.

10. The transmission device for a phase shifter as recited in claim 9, characterized in that the lead screw has a flange that is associated with the flange of the locking connector for defining the second position of the locking connector.

11. The transmission device for a phase shifter as recited in claim 1, wherein the lead screw drive is a first lead screw drive, and further comprising a second lead screw drive rotatably supported on the support, wherein the first and second lead screw drives are arranged side by side in parallel.

* * * * *